US005575035A

United States Patent [19]

Reis et al.

[11] Patent Number: 5,575,035

[45] Date of Patent: Nov. 19, 1996

[54] ENVIRONMENTALLY SOUND AND SAFE APPARATUS FOR REMOVING COATINGS

[75] Inventors: Carl A. Reis, Torrance; Nicholas T. Castellucci, San Pedro; Richard A. Osterman, Lomita, all of Calif.

[73] Assignee: Northrop Grumman Corporation, Los Angeles, Calif.

[21] Appl. No.: 590,798

[22] Filed: Jan. 24, 1996

[51] Int. Cl.[6] ..... A47L 9/06

[52] U.S. Cl. ..... 15/324; 15/339; 15/345; 15/401; 15/371

[58] Field of Search ..... 15/345, 339, 401, 15/324, 371

[56] References Cited

U.S. PATENT DOCUMENTS

| | | | |
|---|---|---|---|
| 2,481,760 | 9/1949 | Leher . | |
| 2,613,310 | 10/1952 | Green . | |
| 2,618,004 | 11/1952 | Heyder . | |
| 2,637,062 | 5/1953 | Sutton et al. | 15/324 |
| 3,036,190 | 5/1962 | Johnson . | |
| 3,109,083 | 10/1963 | Meltaer | 15/401 X |
| 4,404,705 | 9/1983 | Thoma | 15/401 X |
| 4,466,851 | 8/1984 | Hoffman . | |
| 4,690,724 | 9/1987 | Outlaw . | |
| 4,947,515 | 8/1990 | Ivarsson | 15/401 |
| 5,116,152 | 5/1992 | Caswell . | |
| 5,287,593 | 2/1994 | Sprunger | 15/401 |

*Primary Examiner*—Chris K. Moore

*Attorney, Agent, or Firm*—Terry J. Anderson; Karl J. Hoch, Jr.

[57] ABSTRACT

The present invention is a hand held tool for removing coatings from a substrate. The hand held tool includes a housing having a front section with an outlet, a mid section with an inlet, and a rear section, a heat source disposed within the front section of the housing for emitting heat through the outlet, and a vacuum source disposed within the mid section of the housing for providing suction through the inlet. The hand held coating remover further includes a power source disposed within the rear section for supplying power to the heat source and the vacuum source, a control panel having a heat controller for adjusting and controlling the heat emitted from the heat source through the outlet and a vacuum controller for adjusting and controlling the suction provided by the vacuum through the inlet, and a blade located adjacent to the inlet and resiliently coupled to the housing. The coating is safely removed from the substrate by first heating the coating, moving the blade across the heated coating to scape the coating, and vacuuming the coating as it is scraped or removed from the substrate. Also, any fumes that are created when the coating is heated is easily removed by the vacuum.

14 Claims, 2 Drawing Sheets

ENVIRONMENTALLY SOUND AND SAFE APPARATUS FOR REMOVING COATINGS

BACKGROUND OF THE INVENTION

1. Field of the Invention

The present invention relates to coating removers, and in particular to an environmentally safe hand held coating remover.

2. Related Art

Various tools have been previously disclosed and used to remove coatings, such as paint, from substrates. For example, U.S. Pat. No. 2,481,760, entitled "Vapor Superheating System and Apparatus" issued to Leher on Sep. 13, 1949, discloses a tool for removing paint from a surface by first heating the paint with steam and then scraping the steam heated paint. U.S. Pat. No. 2,613,310, entitled "Electronically Heated Paint Remover Tool" issued to Green on Oct. 7, 1952, discloses an electrically heated tool for removing paint from surfaces by first heating the paint with a heating element and then scraping the heated paint from the surface with a blade. U.S. Pat. No. 2,618,004, entitled "Combined Paint Scraper and Flame Guard" issued to Heyder on Nov. 18, 1952, discloses a paint scraper for use with an open flame for removing paint from a surface.

However, none of the devices disclosed above are safe for the user. For example, all of the devices disclosed above expose the user to potentially dangerous toxic vapors. In addition, all of the devices disclosed above expose the environment to the dangerous toxic vapors.

Therefore, what is needed is a tool for safely removing coatings from a substrate without harming the user or the environment. What is also needed is a tool for removing coatings from a substrate that does not damage the substrate. What is additionally needed is a tool for removing coatings from a substrate having a device for eliminating solvents and chemicals as the coating is removed from the substrate. What is further needed is a tool for removing coatings from a substrate that eliminates the need for sanding and blasting.

Whatever the merits of the above mentioned systems and methods, they do not achieve the benefits of the present invention.

SUMMARY OF THE INVENTION

To overcome the limitations in the prior art described above, and to overcome other limitations that will become apparent upon reading and understanding the present specification, the present invention is a hand held tool for removing coatings from a substrate.

The hand held tool includes a housing having a front section with an outlet, a mid section with an inlet, and a rear section, a heat source disposed within the front section of the housing for emitting heat through the outlet, and a vacuum source disposed within the mid section of the housing for providing suction through the inlet. The hand held coating remover further includes a power source disposed within the rear section for supplying power to the heat source and the vacuum source, a control panel having a heat controller for adjusting and controlling the heat emitted from the heat source through the outlet and a vacuum controller for adjusting and controlling the suction provided by the vacuum through the inlet, and a blade for removing the coating located adjacent to the inlet and resiliently coupled to the housing.

The hand held tool of the present invention further includes a view window with a light source within the front section, a heat shield attached to the front section, and a roller at the rear section. The coating is safely removed from the substrate by first heating the coating with the heat emitted from the outlet. Second, the blade is moved across the heated coating to scrape the coating. Next, the coating is vacuumed as it is scraped or removed from the substrate. Also, any fumes that are created when the coating is heated is easily removed by the vacuum. The view window provides precision and convenient viewing of the coating before it is removed, the heat shield focuses the heat onto a concentrated area of the substrate, and the roller provides smooth movement and scraping of the coating as the tool moves across the substrate.

An advantage of the present invention is the ability to safely remove coatings from a substrate without harming the user, the environment, or the substrate. Also, the present invention removes coatings from a substrate without the need for solvents, chemicals, heavy sanding, and blasting.

The foregoing and still further features and advantages of the present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
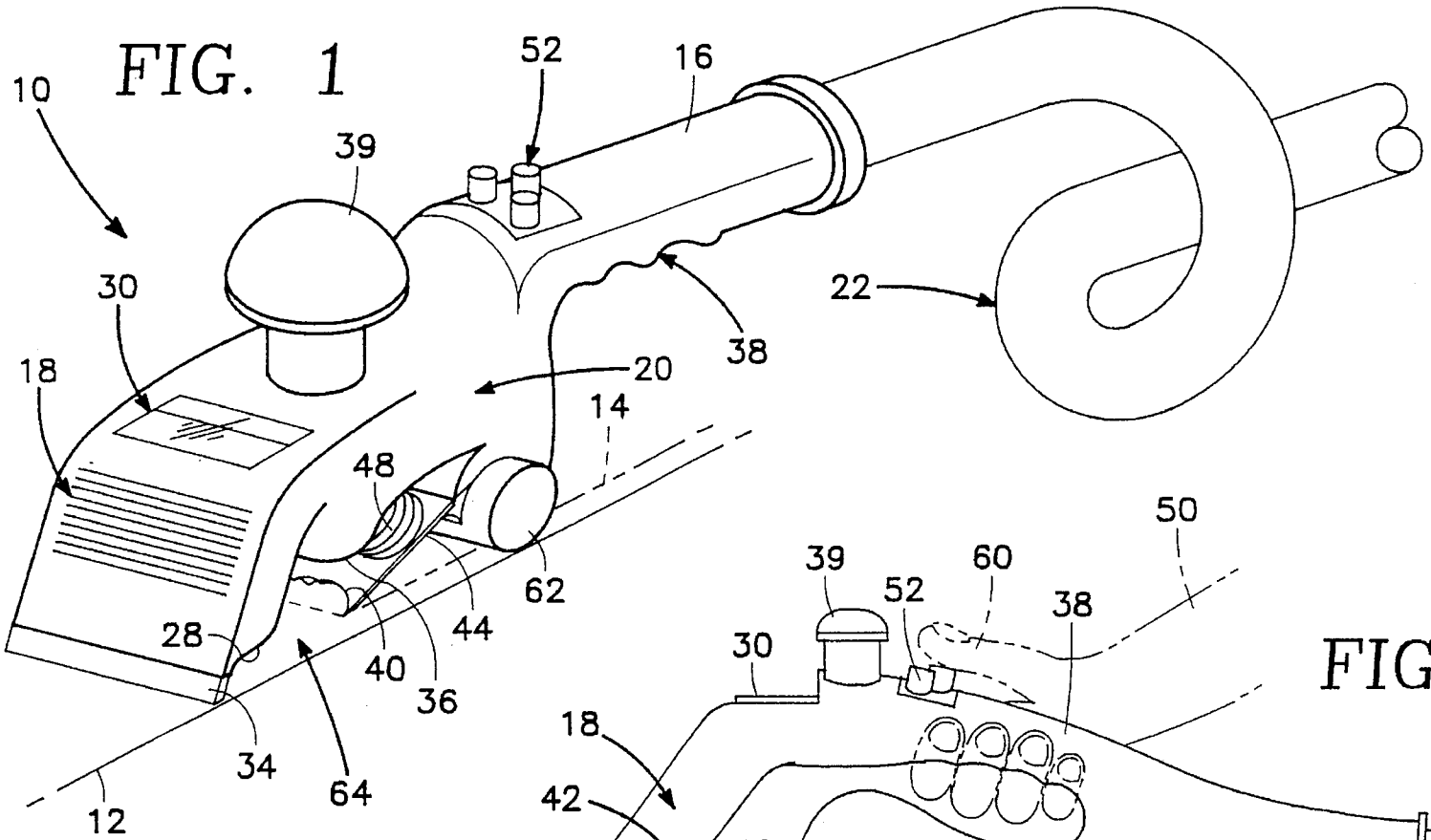
FIG. 1 is a perspective view of a preferred embodiment of the hand-held coating remover of the present invention.
Figure 2:
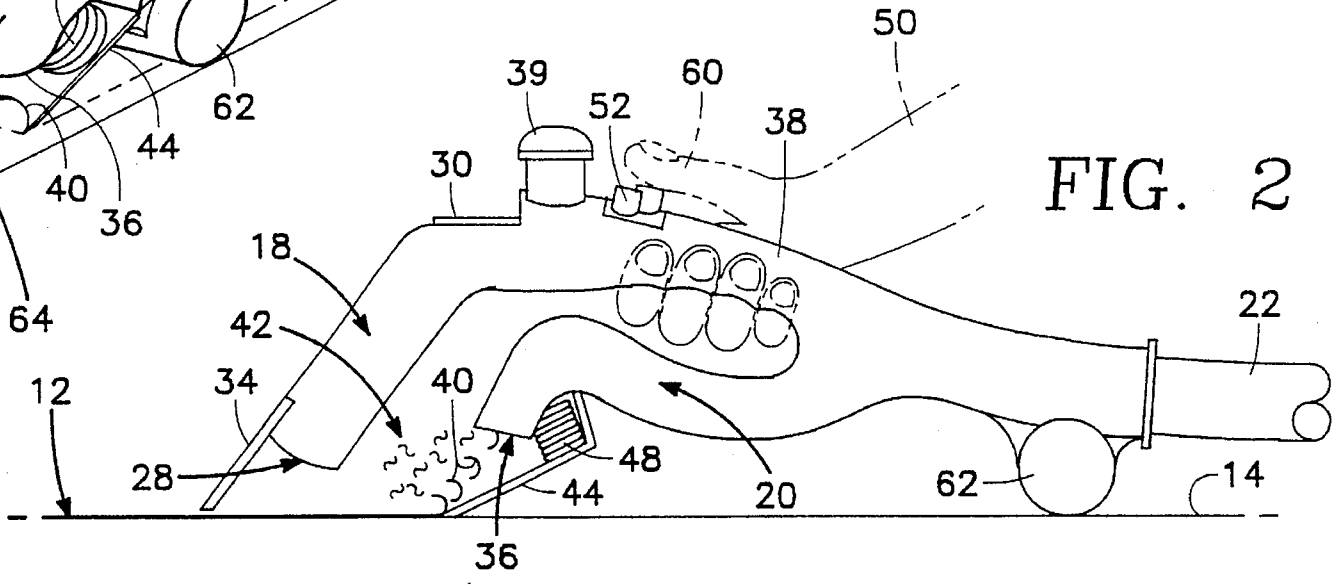
FIG. 2 is a side view of an alternative embodiment of the hand-held coating remover of the present invention.

FIG. 1 is a perspective view of the hand-held coating remover tool of the present invention. FIG. 2 is a side view of an alternative embodiment of the hand-held coating remover of the present invention. The tool 10 is for removing coatings 12, such as paint, varnish, and lacquer, from substrates 14. The tool 10 is comprised of a housing 16 preferably composed of a heat insulating material, such as a heat resistent plastic or polymer. The tool 10 of both embodiments (FIGS. 1 and 2) has substantially similar front sections 18 and rear sections 22, but different mid sections 20. The differing mid sections 20 of FIGS. 1 and 2 will be discussed in detail below.

The front section 18 of FIGS. 1 and 2 is relatively wide and extends from the mid section 20 at an acute angle toward the substrate 14. The front section 18 also has an outlet 28 at an end directly facing and in close proximity to the substrate 14. A heat source (not shown) is disposed within the front section 18 of the housing 16 for emitting heat through the outlet 28 onto the coating 12 of the substrate 14.

Figure 5:
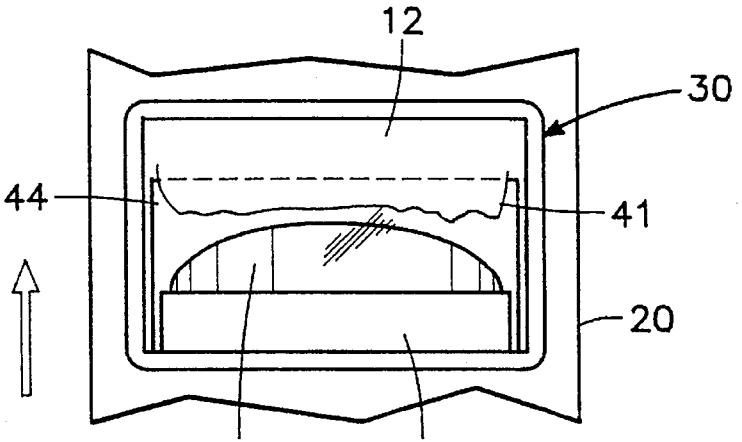
FIG. 5 is a detailed view of the view window of the present invention.

Referring to FIG. 5 along with FIGS. 1 and 2, the front section 18 further includes a view window 30 with a light source 32 and a shield 34. The light source 32 is at an angle suitable to provide light to an area on the substrate 14 adjacent the outlet 28. The view window 32 provides precise and convenient viewing of the coating 12 before and after it is removed from the substrate 14. The shield 34 can be an infrared shield and extends from the outlet 28 toward the substrate 14. The shield 34 extends past the outlet 28 of the front section 18 and preferably extends at the same acute angle as the front section 18.

The mid section 20 of both embodiments (FIGS. 1 and 2) is comprised of an inlet snout 36, a handle 38, and a stabilizer knob 39. In both embodiments (FIGS. 1 and 2), the handle 38 is shaped to allow gripping by one hand 50 and the stabilizer knob 39 is shaped to allow gripping and downward pressure by the other hand (not shown). The inlet snout 36 of both embodiments (FIGS. 1 and 2) extends at an acute angle away from the substrate 14 to the rear section 22. However, in the preferred embodiment (FIG. 1), the inlet snout 36 extends from the handle 38 to near the substrate 14. In contrast, in the alternative embodiment (FIG. 2), the inlet snout 36 does not extend from the handle 38, but instead extends from the rear section 22. As a result, the hand 50 grips the mid section 20 of FIG. 2 between the handle 38 and the inlet snout 36, unlike the configuration of FIG. 1.

A vacuum source (not shown) of both embodiments (FIGS. 1 and 2) is located within the housing 16 of the mid section 20 for providing suction through the inlet snout 36. A disposal device (not shown) is coupled to the inlet snout 36 near the rear section 22 for disposing of matter vacuumed through the inlet snout 36.

Figure 3:
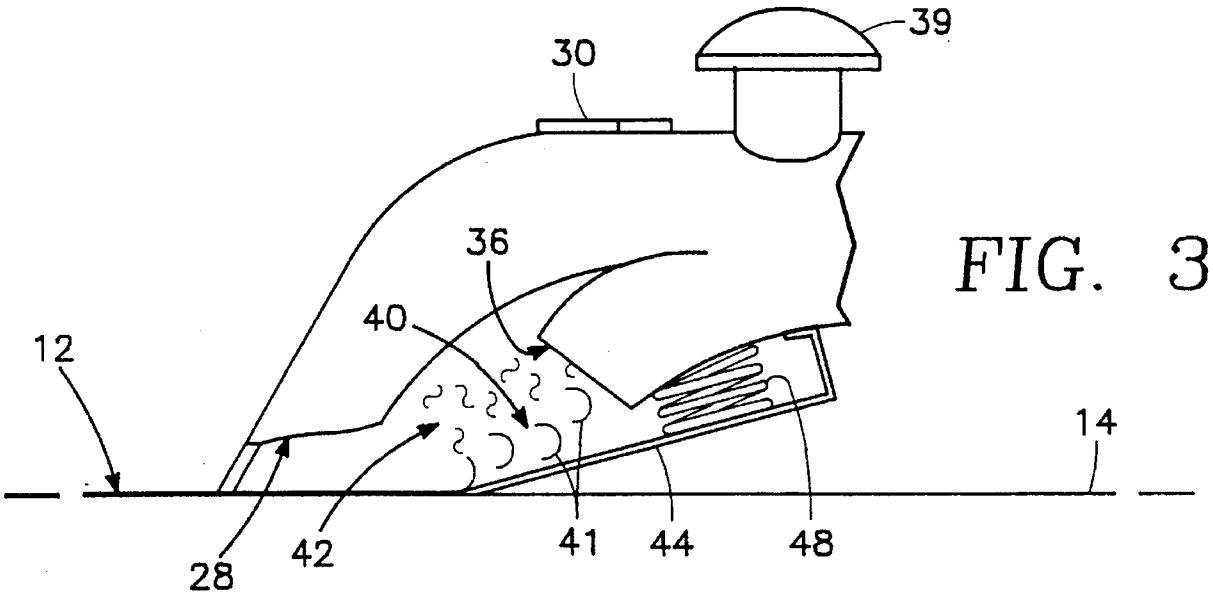
FIG. 3 is a break-away detailed view of the blade, vacuum, and heater of the present invention.

Referring to FIG. 3 along with FIGS. 1, 2, and 5, a blade 44 is resiliently coupled to the mid section 20 and extends from a portion on the inlet snout 36 downwardly at an acute angle toward the substrate 14. The blade 44 of both embodiments (FIGS. 1 and 2) is configured on the inlet snout 36 in a similar manner. The blade 44 has a scraping edge 46 at a front position of the blade 44 which faces forward and contacts the coating 12 of the substrate 14. The scraping edge 46 of the blade 44 preferably contacts the substrate 14 at an angle sufficient to facilitate penetration into only the coating 12, thereby preventing any damage to the substrate 14. The blade 44 can be coupled to the mid section 20, for example, via a helical or flat spring 48.

Figure 4:
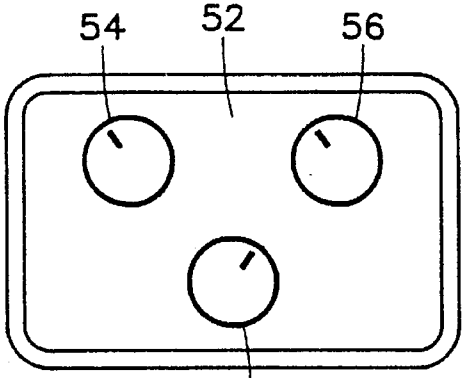
FIG. 4 is a detailed view of the control panel in one embodiment of the present invention.

Referring to FIG. 4 along with FIGS. 1–3 and 5, the handle 38 of both embodiments (FIGS. 1 and 2) has a control panel 52 having a heat controller 54 for adjusting and controlling the amount of heat emitted from the heat source through the outlet 28 and a vacuum controller 56 for adjusting and controlling the amount of suction provided by the vacuum through the inlet 36. The control panel 52 also has a light controller 58 for adjusting the intensity of light emitted from the light source 32. The heat, vacuum, and light controllers 54, 56, 58 can be standard rheostat devices. The control panel 52 of both embodiments (FIGS. 1 and 2) is conveniently located near the handle 38 so that when the handle 38 is gripped by a hand 50, the controllers of the control panel 52 can be easily activated by the thumb 60 of the hand 50.

The rear section 22 of the housing 16 extends from the mid section 20 at an angle toward the substrate 14. The rear section 22 contains a power source electrically coupled to an external power outlet (not shown) or an internal power outlet (not shown), such as a battery pack, at one end and electrically coupled to the heat source, the vacuum source, and the light source at another end. The power source supplies electrical power to the heat source, the vacuum source, and the light source.

The rear section 22 also has a roller 62 rotatably coupled to it. The roller 62 contacts the substrate 14 when the tool 10 is in use and operates in conjunction with the blade 44. The roller 62 also provides rear support to the resilient blade 44 as the blade 44 penetrates the coating 12. This arrangement allows the blade 44 to scrape the coating 12 at a consistent angle and allows smooth movement of the tool 10 across the substrate 14 during use. The spring 48 resiliently urges the blade 44 against the substrate 14 so that the scraping edge 46 of the blade 44 is under compression while in contact with the coating 12 of the substrate 14. Thus, the roller's 62 smooth control operates in combination with the blade's 44 resiliency to protect the substrate 14 and prevent it from being damaged.

The coating 12 is safely removed from the substrate 14 by first placing the tool 10 on the substrate 14 so that the blade 44 of the tool is positioned near the beginning portion of the coating 12 to be removed from the substrate 14. The heat, vacuum, and light controllers 54, 56, 58 are then activated to set a desired amount of heat, suction, and light intensity, of the heat source, vacuum, and light source, respectively.

The heat setting can depend on many factors such as the type of coating, the thickness of the coating, and the type of substrate. The coating 12 is heated and softened by the heat radiating from the heat source through the outlet 28. The shield 34 of the front section 18 shields and focusses the heat emitted through the outlet 28 onto a concentrated area of the substrate 14. This allows only portions 64 of the coating 12 that are to be immediately scraped by the blade 44 to be heated.

One hand 50 grips the handle 38 while the other hand (not shown) grips the stabilizer knob 39. The tool 10 is then moved across the substrate 14 to facilitate removal of the heated and softened coating 12 by the scraping edge 46 of the blade 44. The other hand applies a force on the stabilizer knob 39 toward the coating 12. This allows the stabilizer knob 39 to provide pressure on the substrate 14 so that the tool 10 moves across the substrate 14 with a consistent hand controllable pressure.

Since the heat source is located in advance of the blade 44, while the scraping edge 46 of the blade 44 removes the coating 12, the heat radiated from the heat source heats and softens the next adjacent area of the coating 12 directly in front of the coating 12 being currently removed by the blade 44. Also, since the spring 48 is under compression while in contact with the coating 12 of the substrate 14, the tool 10 is smoothly moved across the substrate 14 and the coating 12 is precisely removed. This is because the roller 62 acts in combination with the resiliency of the blade 44 to provide alignment of the scraping edge 46 of the blade 44 with the substrate 14 as the tool 10 is moved across the substrate 14. Thus, the substrate 14 is not damaged as the coating 12 is precisely removed.

During removal of the coating 12, coating scrapings 40 and coating matter is produced. The coating scrapings 40 are usually of a curled or spiral shape as the blade removes the coating 12 from the substrate 14. Typically, there is approximately one coating scraping 41 per inch of movement of the tool 10. Also, as the coating 12 is heated and softened, fumes and vapors 42 are produced. The coating scrapings 40 and fumes and vapors 42 are easily and conveniently removed by the vacuum source of the tool 10. Specifically, the vacuum source vacuums the coating scrapings 40 and fumes vapors 42 through the inlet 36 as the coating scrapings 40 and fumes vapors 42 are produced. Therefore, toxic refuse is immediately removed to provide safety to the user and the environment.

In addition, during operation of the tool 10, the view window 30 provides precise and convenient viewing of the coating 12 before it is removed. Since the light source 32 emits light onto the immediate area being scraped 64, the area being scraped 64 can be precisely viewed. This arrangement allows the user to see the coating 12 as it is scraped so that necessary adjustment of the controllers 54, 56, 58 can be made to more effectively scrape the coating 12 from the substrate 14. Therefore, the coating is removed from the substrate without harming the user, the environment, or the substrate.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for removing coatings from a substrate, comprising:

a housing having a front section with an outlet, a mid section with an inlet, and a rear section;

a heat source disposed within said front section of said housing for emitting heat through said outlet;

a vacuum source disposed within said mid section of said housing for providing suction through said inlet;

a power source disposed within said rear section for supplying power to said heat source and said vacuum source;

a control panel having heat controller means for adjusting and controlling said heat emitted from said heat source through said outlet and a vacuum controller means for adjusting and controlling said suction provided by said vacuum through said inlet; and a blade located adjacent to said inlet and resiliently coupled to said housing for resiliently urging said blade against said substrate, wherein said blade is moved across said substrate for scraping and removing said coating from said substrate, and wherein said blade is under compression while in contact with said coating of said substrate.

2. The invention as set forth in claim 1, wherein the heat source is an infrared heater.

3. The invention as set forth in claim 1, further comprising a view window disposed within said front section at an opposite end from said outlet.

4. The invention as set forth in claim 3, further comprising a light source disposed within said front section between said view window and said outlet at an angle suitable to provide light to an area on said substrate adjacent said outlet, wherein said light source is coupled to said power source.

5. The invention as set forth in claim 4, wherein said control panel further comprises a light controller means for controlling and adjusting an intensity of said light source.

6. The invention as set forth in claim 5, wherein said heat controller means, said vacuum controller means, and said light controller means are rheostats.

7. The invention as set forth in claim 1, further comprising a roller rotatably coupled between said rear section and said substrate.

8. The invention as set forth in claim 1, wherein said blade is coupled to said housing with a helical spring.

9. The invention as set forth in claim 1, further comprising an infrared shield extending from said outlet toward said substrate for focussing said heat emitted through said outlet onto a concentrated area of said substrate.

10. The invention as set forth in claim 1, wherein said heat controller means and said vacuum controller means are rheostats.

11. A compact hand held coating remover for removing coatings on a substrate, comprising:

a housing having a front section with an outlet, a mid section with an inlet, and a rear section;

an infrared heater disposed within said front section of said housing for emitting heat through said outlet;

a vacuum source disposed within said mid section of said housing for providing suction through said inlet;

a view window disposed within said front section at an opposite end from said outlet;

a light source disposed within said front section between said view window and said outlet at an angle suitable to provide light to an area on said substrate adjacent said outlet;

a power source disposed within said rear section for supplying power to said infrared heater, said vacuum source, and said light source;

a control panel having a heat controller for adjusting and controlling said heat emitted from said infrared heater, a vacuum controller for adjusting and controlling said suction provided by said vacuum, and a light controller for controlling and adjusting an intensity of said light source;

a roller rotatably coupled between said rear section and said substrate and a blade located adjacent to said inlet and resiliently coupled to said housing for resiliently urging said blade against said substrate, wherein said blade is moved across said substrate for scraping and removing said coating from said substrate, and wherein said blade is under compression while in contact with said coating of said substrate.

12. The invention as set forth in claim 11, wherein said blade is coupled to said housing with a helical spring.

13. The invention as set forth in claim 11, further comprising an infrared shield extending from said outlet toward said substrate for focussing said heat emitted through said outlet onto a concentrated area of said substrate.

14. The invention as set forth in claim 11, wherein said heat controller means and said vacuum controller means are rheostats.

* * * * *